US005403271A

United States Patent [19]

Saunders et al.

[11] Patent Number: 5,403,271

[45] Date of Patent: Apr. 4, 1995

[54] SPORTING BELT APPARATUS

[75] Inventors: Harold D. Saunders, Eden Prairie; Greg Gagne, Bloomington; Verne Gagne, Excelsior, all of Minn.

[73] Assignee: AWA American Sumo, Inc., Minneapolis, Minn.

[21] Appl. No.: 201,719

[22] Filed: Feb. 25, 1994

Related U.S. Application Data

[63] Continuation of Ser. No. 20,320, Feb. 19, 1993, abandoned.

[51] Int. Cl.[6] ..... A61F 13/00; A61F 5/37

[52] U.S. Cl. ..... 602/60; 602/67; 128/876

[58] Field of Search ..... 128/876; 602/19, 62-67; 2/78 R, 78 A, 78 B, 78 C, 78 D, 400, 401, 403, 404, 405

[56] References Cited

U.S. PATENT DOCUMENTS

| | | | |
|---|---|---|---|
| 1,254,463 | 1/1918 | Arrington | 602/67 |
| 1,599,688 | 9/1926 | Sullivan . | |
| 2,088,302 | 7/1937 | McKeever | 602/67 |
| 2,102,323 | 12/1937 | Kneibler | 602/67 |
| 2,232,246 | 2/1941 | Klein . | |
| 2,249,198 | 7/1941 | Carter . | |
| 2,264,384 | 12/1941 | Kneibler | 602/67 |
| 2,313,992 | 3/1943 | Frederickson | 602/67 |
| 2,328,087 | 8/1943 | McDonald | 602/67 |
| 2,481,396 | 9/1949 | Cohen . | |
| 2,553,353 | 5/1951 | Binder et al. . | |
| 2,641,258 | 6/1953 | Rutledge . | |
| 2,910,984 | 11/1959 | Yeakey et al. . | |
| 3,029,814 | 4/1962 | Kravitz . | |
| 3,083,710 | 4/1963 | Rauser | 602/67 |
| 3,141,457 | 7/1964 | Davidson . | |
| 3,234,937 | 2/1966 | Nelkin . | |
| 3,441,027 | 4/1969 | Lehman . | |
| 3,526,229 | 9/1970 | Blair . | |
| 3,756,247 | 9/1973 | Hand . | |
| 4,400,832 | 8/1983 | Kinder . | |
| 4,475,543 | 10/1984 | Brooks et al. . | |
| 4,870,958 | 10/1989 | Webster | 602/67 |
| 5,040,524 | 8/1991 | Votel et al. . | |
| 5,131,100 | 7/1992 | Atwater | 602/67 |

OTHER PUBLICATIONS

*Managing Lower Back Pain, 2d Ed.*, W. H. Kirkaldy-Willis, Churchill Livingstone, 1988, pp. 297-303.

*Camp Therapy Products Price List*, Camp International, Inc., Jun. 1988.

News release article on the Dyna-Life TM Active Support Belt.

Saunders Therapy Products catalog, pp. 26, 27, 28 and 35.

Saunders Therapy Products *Educational Opportunities 1991 Catalog* (Revised Fall 1991).

*Primary Examiner*—Michael A. Brown

*Attorney, Agent, or Firm*—Schwegman, Lundberg & Woessner

[57] ABSTRACT

A sporting belt apparatus which may be gripped by an athletic opponent comprising a sporting belt and a compression short wherein the compression short maintains the vertical position of the sporting belt relative to the waist of the wearer during active movement of the wearer. The sporting belt is adapted to circumferentially extend around the waist area of a wearer and has a thickness sufficient to allow easy gripping of the sporting belt by the opponent. The compression short has elastic means for conforming said compression short tightly to the pelvis of the wearer and includes a crotch strap which is secured to the sporting belt to maintain the vertical position of the sporting belt relative to the waist of the wearer when an upward force is exerted on the sporting belt. The sporting belt apparatus includes elastic means for conforming the sporting belt tightly to the waist of a wearer. Preferably, a reinforcing connection strip is provided to secure the compression short to the sporting belt with the reinforcing connection strip and the sporting belt cooperating to define a channel located between the reinforcing connection strip and the bottom portion of the sporting belt.

9 Claims, 3 Drawing Sheets

SPORTING BELT APPARATUS

This is a continuation of application Ser. No. 08/020,320, filed Feb. 19, 1993, now abandoned.

BACKGROUND OF THE INVENTION

1. Field of the Invention

This invention relates generally to sporting belts, and more specifically to a sporting belt apparatus designed for sumo wrestlers.

2. Description of the Art

The sport of sumo wrestling has been around for thousands of years. As a background, sumo wrestling involves two competitors confined within a circular area. The object of the sport is to push your opponent out of the ring or cause your opponent to touch the ground within the ring with any part of his body other than his feet. The only equipment worn by the sumo wrestler is a sumo belt.

The typical sumo belt known in the art consists of a segment of cloth approximately 30 feet in length. The cloth is folded lengthwise a number of times, passed between the legs, and then wrapped around the waist. The cloth is finally tied in a knot at the back of a wearer.

The belt of a sumo wrestler is often used as a means for controlling the opponent. A common technique in sumo wrestling is to gain a grip on the belt of an opponent and then lift the opponent out of the ring, or utilize the belt to throw the opponent to the ground. Thus, in sumo, a great amount of force is applied to the belt of a competitor.

For a more detailed description of sumo wrestling, the reader is referred to the text *Sumo: A Pocket Guide* by W. Long, chap. 3,7,8 (1989), the disclosure of which is incorporated by reference herein.

Traditional sumo belts have a number of problems. First, because sumo belts are attached to the wearer by a simple piece of cloth passing between the legs of a competitor, a great deal of force is applied through the cloth directly to the groin area of a wearer. Thus, the belt is uncomfortable to the wearer since any upward force on the belt is then concentrated along the strap between his legs. Additionally, the long cloth is time-consuming to attach to the wearer since it must be wrapped in a layered fashion and tied off in a knot at the back area. Also, with the belt simply tied in a knot, sumo belts have a tendency to come loose during a sumo match.

Another problem associated with sumo wrestling is the potential for injury. A common technique in sumo wrestling involves a quick forward lunge toward the opponent, and with the average sumo wrestler weighing in excess of 300 lbs., there is a great potential for injury to the hamstring, quadriceps, abdomen, and groin muscles. Thus, there is a need for providing support to these muscles for the sumo wrestler. The typical belt worn by the sumo wrestler, however, does not provide support to these areas.

SUMMARY OF THE INVENTION

The present invention provides a comfortable combination sporting belt and compression short for athletes such as sumo wrestlers.

The present invention is directed to a sporting belt apparatus which enables a sumo wrestler to comfortably wear a belt around his waist in a manner that ensures that the belt will stay in place during use, and that forces applied to the belt are evenly distributed over the mid-section of the wearer, while simultaneously providing support to the upper thigh, groin, and abdominal muscles of the sumo competitor.

Preferably, the sporting belt apparatus should be easy to put on and take off.

According to one aspect of the invention, there is provided a sporting belt apparatus for athletes comprising a sporting belt adapted to circumferentially extend around the waist area of a wearer and having a thickness sufficient to allow easy gripping by an opponent, and a compression short operatively connected with the sporting belt wherein the compression short maintains the vertical position of the sporting belt relative to the waist of the wearer during active movement of the wearer.

The compression short preferably comprises an elastic material for conforming the compression short tightly to the pelvis of the wearer. According to one aspect of the invention, the compression short includes leg portions which are designed and configured to extend at least partially down the thigh region of the wearer, to support the thigh and groin area muscles to help prevent injuries to these muscles.

Alternatively, the compression short may be configured as a brief.

According to another aspect of the invention, the compression short includes a reinforcing crotch strap which is secured to the sporting belt to maintain the vertical position of the sporting belt relative to the waist of the wearer when an upward force is exerted on the sporting belt.

Preferably, the sporting belt includes adjacent ends with an elastic strip attached to the ends of the sporting belt such that the strip expands when the sporting belt apparatus is worn by a wearer to tightly conform the sporting belt to the waist of the wearer.

According to another aspect of the invention, there is provided a reinforcing connection strip of flexible material which is secured between the compression short and the sporting belt. The reinforcing connection strip facilitates the efficient and uniform transfer of force from the sporting belt to the compression short while preventing the sporting belt from separating from the compression short when force is applied to the sporting belt. Preferably, the reinforcing connection strip is secured to the sporting belt in a position between the top and bottom portions of the belt. In this way, the bottom portion of the sporting belt and the reinforcing connection strip cooperate to define a channel or expandable slot located between the bottom portion of the sporting belt and the reinforcing connection strip so that the bottom portion of the sporting belt is easily gripped by the sumo competitors.

The above-described features and advantages, along with various other advantages and features of novelty, are pointed out with particularity in the claims of the present application which form a part hereof. However, for a better understanding of the invention, its advantages, and objects obtained by its use, reference should be made to the drawings which form a further part of the present application and to the accompanying descriptive matter in which there is illustrated and described preferred embodiments of the invention.

DETAILED DESCRIPTION OF THE INVENTION

Figure 1:
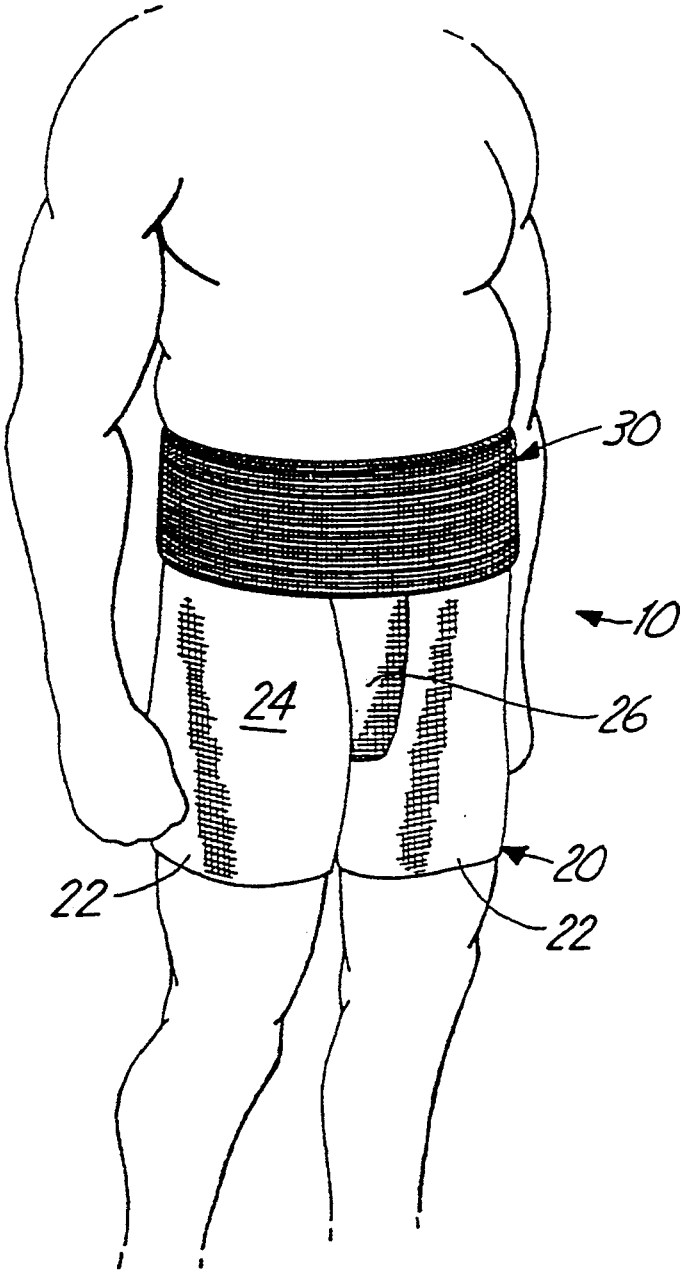
FIG. 1 is a front perspective view of a preferred sporting belt apparatus illustrated as it would be operatively positioned on a human body.

Referring now to the drawings, in which similar elements are numbered identically throughout, a description of preferred embodiments is provided. In FIG. 1, a perspective view of a sporting belt apparatus according to the principles of the invention is generally illustrated at 10. The sporting belt apparatus 10 is designed to be worn by an athlete, in particular, a sumo wrestler. The sporting belt apparatus 10 generally comprises a combination of a lower compression short/pant portion 20, to which is secured a sporting belt portion 30.

The compression short 20 is preferably constructed from a light- to medium-weight elastic material appropriately stitched to form the short or pant configuration. The elastic material 24 may be of any appropriate type which provides the desired compressive support to the body, yet is comfortable to wear. Examples of materials which are suitable for the purpose include cotton/-poly/Lycra® fabric, and nylon/Spandex® material. Both offer the preferred four-way stretch and provide graduated compression and support to the hamstring, quadriceps, groin area, and abdominal muscles encircled thereby. In a preferred embodiment of the invention, the compression short 20 includes leg portions 22 which extend from the waist area of the compression short to a mid-thigh position so as to give compressive support to both the hamstring and the quadriceps muscles of the wearer. It will be appreciated that by providing support to the hamstring, quadriceps, groin area and abdominal muscles, the compression short helps to reduce the potential injury to these muscles of the wearer, especially since a sumo wrestler often engages in quick forward lunges during a sumo match.

It will be understood from a more complete description of the invention that the principles of the invention would apply equally well to a compression short configuration having truncated leg portions which terminate adjacent the crotch area, typically referred to as a "brief" configuration. Such configuration, while providing less support to the hamstring and quadriceps muscles, still provides support for the groin area muscles and accomplishes the purposes of maintaining the vertical position of the sporting belt 30 relative to the waist of the wearer during active movement of the wearer.

While the present invention is described with respect to particular brands and types of materials, it will be understood by those skilled in the art that the invention is not to be limited by any particular type or brand of material, that such materials are used for descriptive purposes only. Further, while the invention is described with regard to a particular style of compression short having a particular leg configuration, the invention is not so limited, but applies equally well to shorts/pants of various styles and configurations and to those having, for example, longer or shorter leg portions.

Pursuant to another aspect of a preferred embodiment of the present invention, the compression short 20 preferably includes a crotch strap 26 to provide reinforcement to the compression short 20 when an upward force is exerted on the sporting belt 30. As mentioned previously, the sporting belt 30 will be subjected to a considerable amount of force as sumo wrestlers utilize the sporting belt to lift or gain leverage over their opponent. To withstand these upward forces on the sporting belt, the crotch strap 26 is preferably made from a strong, reinforcing material that is less flexible than the elastic material 24 of the leg portions 22 of the compression short 20.

The crotch strap 26 is preferably secured to the sporting belt 30 at the front and back location of the belt 30. It will be understood by those skilled in the art that a reinforcing crotch strap 26 may be formed as part of a unitary compression short. Thus, during the actual sumo competition, the crotch strap 26 maintains the vertical position of the sporting belt 30 relative to the waist of the wearer when an upward force is exerted on the sporting belt 30. Additionally, since the crotch strap 26 is secured to the leg portions 22 of the compression short 20, the crotch strap 26 serves to distribute the forces applied to the sporting belt 30 over a wider area, and thus lessen the amount of force applied to a particular point of the wearer to provide a safer and more comfortable belt.

Figure 2:
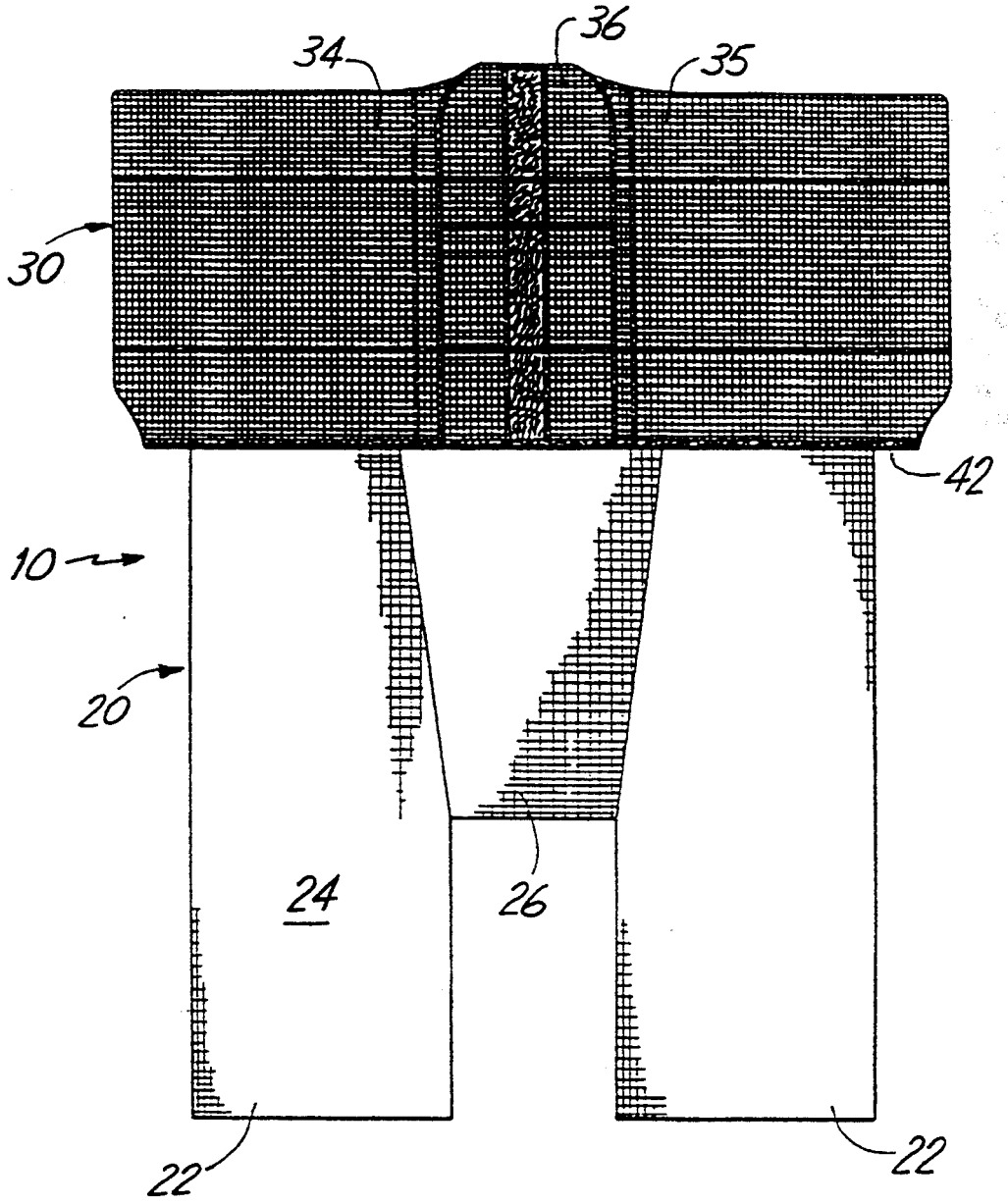
FIG. 2 illustrates a back view of the sporting belt apparatus of FIG. 1.
Figure 3:
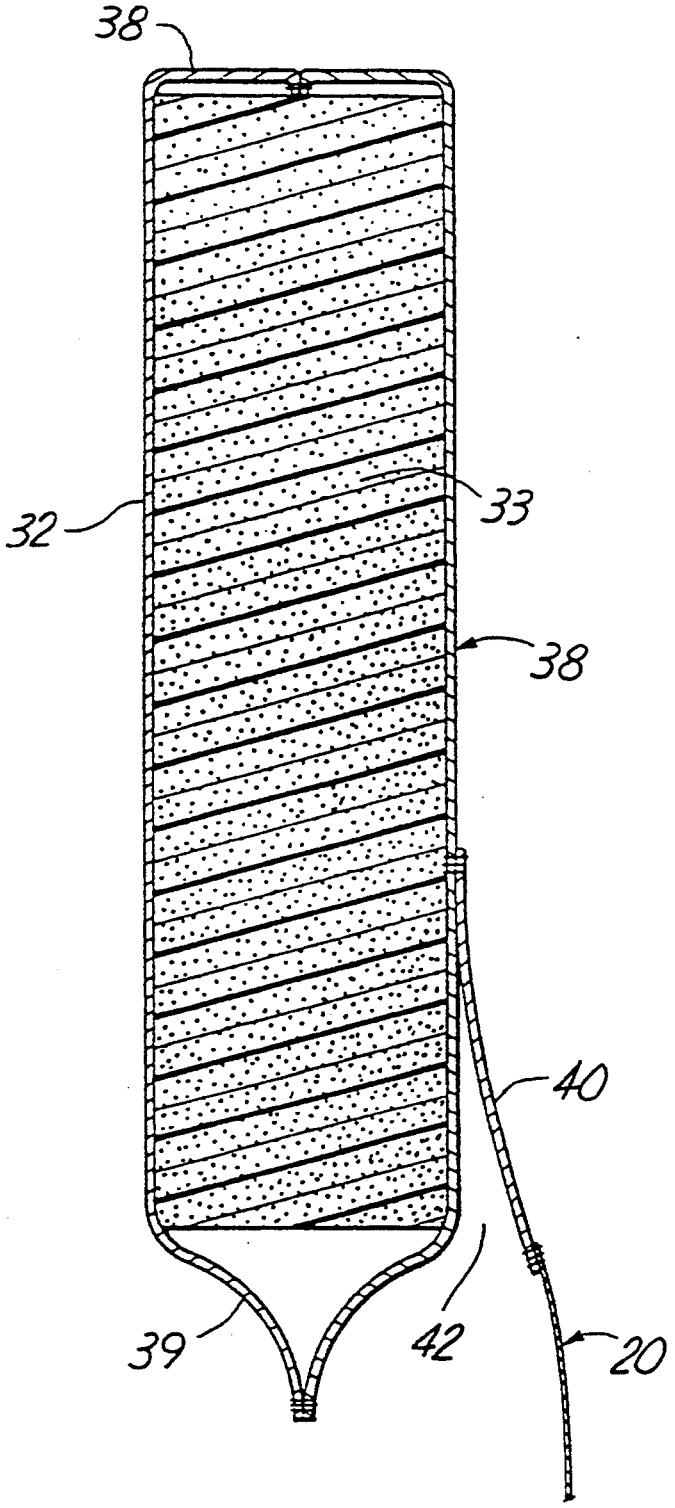
FIG. 3 illustrates an enlarged sectional view of the sporting belt apparatus of FIG. 1.

Referring to FIGS. 2 and 3, the sporting belt 30 includes an outer flexible material 32 and an inner filler 33 having a thickness of approximately 2 inches, and preferably between 1 to 3 inches, to facilitate easy gripping of the sporting belt 30 by the wearer's opponent. The filler 33 is preferably constructed of a dense, semi-rigid foam material, although it will be understood that a variety of materials could be used to perform the same function. The sporting belt 30 is adapted to circumferentially extend around the waist area of a wearer. Preferably, the outer material 32 of the sporting belt 30 is made of a flexible material which is also comfortable to wear. In a preferred embodiment, the sporting belt 30 includes an elastic strip 36 which is designed to conform the sporting belt tightly to the waist of the wearer. The elastic strip 36 is made from a flexible, elastic material and is secured between adjacent ends 34, 35 of the sporting belt 30. As shown in FIG. 2, the elastic strip 36 is located at the rear of the sporting belt 30 and the elastic strip 36 is designed to expand when the sporting belt apparatus 10 is worn by a wearer so that the sporting belt 30 tightly conforms to the waist of the wearer. It is understood that various other types of conforming mechanisms, such as a lace or Velcro® configuration, could be used to secure the sporting belt tightly to the waist of the wearer.

Pursuant to another aspect of the invention, the sporting belt 30 is preferably secured to the compression short 20 through a reinforcing connection strip 40. As shown in FIG. 3, the reinforcement connection strip 40 comprises a flexible strip of material which extends circumferentially around the inside of the sporting belt 30 to secure the compression short 20 to the sporting belt 30.

Although FIG. 3 illustrates the compression short 20 only extending upward to the bottom of the sporting belt 30, it will be understood that it may be desireable for the compression short 20 to extend further upward on the waist of the wearer to provide additional support. For example, the compression short 20 may extend above the top portion 38 of the sporting belt 30 to provide back and abdominal support for the wearer.

It will be appreciated that with the reinforcing connection strip 40 secured between the compression short 20 and the sporting belt 30, the compression short 20 maintains the vertical position of the sporting belt 30 relative to the waist of the wearer during active movement of the wearer. Additionally, since the compression short 20, including the crotch strap 24, is secured circumferentially to the sporting belt 30 through the reinforcing connection strip 40, forces applied to the sporting belt 30 are distributed throughout the compression short 20, thus decreasing the amount of force concentrated at any one point along the compression short 20. This increases the safety and comfort of the sporting belt apparatus 10 when worn by a sumo competitor. Additionally, with the sporting belt 30 and the compression short 20 forming a unitary garment, the sporting belt apparatus 10 is easy to wear since the sumo wrestler puts on the sporting belt apparatus as he would any pair of shorts.

Preferably, the reinforcing connection strip 40 is secured to the sporting belt 30 at a location between the top portion 38 and the bottom portion 39 of the sporting belt 30. In this way, the bottom portion 39 of the sporting belt 30 and the reinforcing connection strip 40 cooperate to define a channel or expandable slot 42 as shown in FIG. 3. It will be appreciated that the channel 42 preferably extends circumferentially around the sporting belt apparatus. The bottom portion 39 of the sporting belt 30 is readily accessible and may be easily gripped by the hands of the wearer's opponent during a sumo match. The elastic strip 36 comforms the sporting belt 30 to the waist of the wearer so that the expandable slot 42 is in an unexpanded configuration when the sporting belt 30 is not being gripped by an athletic opponent.

It is to be understood that even though numerous characteristics and advantages of various embodiments of the present invention have been set forth in the foregoing description, together with the details of the structure and function of various embodiments of the invention, this disclosure is illustrative only and changes may be made in the detail, especially in matters of shape, size, and arrangement of parts, within the principles of the present invention, to the full extent indicated by the broad general meaning of the terms in which the appended claims are expressed.

Other modifications of the invention will be apparent to those skilled in the art in view of the foregoing descriptions. These descriptions are intended to provide specific examples of embodiments which clearly disclose the present invention. Accordingly, the invention is not limited to the described embodiments or to the use of specific elements, dimensions, materials or configurations contained therein. All alternative modifications and variations of the present invention which fall within the spirit and broad scope of the appended claims are covered.

What is claimed is:

1. A sporting belt apparatus which may be gripped by an athletic opponent, comprising:

a sporting belt having an inner surface, a top portion and a bottom portion adapted to circumferentially extend around a waist area of a wearer, the sporting belt having semi-rigid filler means extending substantially around the waist of the wearer for providing the sporting belt with a thickness sufficient to allow easy gripping by the opponent;

a compression short having elastic means for conforming said compression short tightly to the pelvis, groin area, and lower abdominal muscles of the wearer and including a crotch strap which is secured to said sporting belt to generally maintain the vertical position of said sporting belt relative to the waist of the wearer when an upward force is exerted on said sporting belt;

means for securing said compression short to said sporting belt, the means for securing being attached to the inner surface of the sporting belt between the top and bottom portions defining an expandable gripping surface between the bottom portion and inner surface of the sporting belt and the compression short for gripping of the sporting belt by the athletic opponent; and means for conforming said sporting belt tightly to the waist of a wearer and for retaining the gripping surface in an unexpanded configuration when the sporting belt is not gripped by the athletic opponent, wherein said apparatus maintains the vertical position of said sporting belt relative to the waist of the wearer during active movement of the wearer.

2. The sporting belt apparatus according to claim 1 wherein said sporting belt has a first and second end and said means for conforming said sporting belt tightly to the waist of a wearer comprises an elastic strip disposed between said first and second ends of said sporting belt such that said elastic strip contracts when said apparatus is worn by a wearer to tightly conform said sporting belt to the waist of the wearer.

3. The sporting belt apparatus according to claim 1 wherein said means for securing said compression short to said sporting belt includes a reinforcing connection strip of flexible material secured between said compression short and said sporting belt.

4. The apparatus of claim 1 wherein the sporting belt has a thickness of greater than 1".

5. The apparatus of claim 1 wherein the sporting belt has a thickness between 1.0" and 2.5".

6. The apparatus of claim 1 wherein the filler means comprises a semi-rigid foam material.

7. A unitized sporting belt and muscle support system which may be gripped by an athletic opponent, comprising:

an elastic compression short having means for conforming said compression short tightly to the pelvis, groin area, and lower abdominal muscles of the wearer and leg portions designed to extend at least partially down the thigh of the wearer for applying graduated compressive forces to the hamstring and groin area muscles of the wearer;

a sporting belt adapted to extend circumferentially around the waist area of the wearer operatively connected to said compression short to restrain the sporting belt from vertical movement, the sporting belt having an inner surface, a top portion, a bottom portion and semi-rigid filler means extending substantially around the waist of the wearer for providing the sporting belt with a thickness sufficient to allow the opponent to easily grip the bottom portion of the sporting belt;

means for securing said compression short to said sporting belt, the means for securing being attached to the inner surface of the sporting belt between the top and bottom portions defining an expandable gripping surface between the bottom portion and inner surface of the sporting belt and the compression short for gripping of the sporting belt by the athletic opponent; and elastic means for conforming said sporting belt tightly to the waist area of the wearer and for retaining the gripping surface in an unexpanded configuration when the sporting belt is not gripped by the athletic opponent, wherein said apparatus maintains the vertical position of said sporting belt relative to the waist of the wearer during active movement of the wearer.

8. The unitized sporting belt and muscle support system according to claim 7 wherein said compression short includes a reinforced crotch strap operatively connected to said sporting belt to maintain the vertical position of said sporting belt relative to the waist of the wearer when an upward force is exerted on said sporting belt.

9. A sporting belt apparatus which may be gripped by an athletic opponent, comprising:

a sporting belt having an inner surface, a top portion and a bottom portion adapted to circumferentially extend around a waist area of a wearer, the sporting belt having semi-rigid filler means with a thickness of between 1.0 and 3.0 inches extending substantially around the waist of the wearer for providing the sporting belt with a thickness sufficient to allow easy gripping by the opponent;

a compression short having elastic means for conforming said compression short tightly to the pelvis, groin area, and lower abdominal muscles of the wearer and including a crotch strap which is secured to said sporting belt to generally maintain the vertical position of said sporting belt relative to the waist of the wearer when an upward force is exerted on said sporting belt;

means for securing said compression short to said sporting belt, the means for securing attached to the inner surface of the sporting belt between the top and bottom portions defining an expandable gripping surface between the bottom portion and inner surface of the sporting belt and the compression short for gripping of the sporting belt by the athletic opponent; and means for conforming said sporting belt tightly to the waist of a wearer and for retaining the gripping surface in an unexpanded configuration when the sporting belt is not gripped by the athletic opponent, wherein said apparatus maintains the vertical position of said sporting belt relative to the waist of the wearer during active movement of the wearer.

* * * * *